US009672673B1

(12) United States Patent
Gokcebay

(10) Patent No.: US 9,672,673 B1
(45) Date of Patent: Jun. 6, 2017

(54) ELECTRONIC LOCKER LOCK SYSTEM

(71) Applicant: Digilock Asia Ltd., Kowloon (HK)

(72) Inventor: Asil T. Gokcebay, Petaluma, CA (US)

(73) Assignee: Digilock Asia Ltd., Kowloon (HK)

( * ) Notice: Subject to any disclaimer, the term of this patent is extended or adjusted under 35 U.S.C. 154(b) by 0 days.

(21) Appl. No.: 15/077,846

(22) Filed: Mar. 22, 2016

(51) Int. Cl.
*G07C 9/00* (2006.01)
*E05B 65/02* (2006.01)

(52) U.S. Cl.
CPC ..... *G07C 9/00309* (2013.01); *E05B 65/025* (2013.01); *G07C 9/00103* (2013.01); *G07C 9/00119* (2013.01)

(58) Field of Classification Search
CPC ..... G07C 9/00857; G07C 9/00309; G07C 2009/00769; E05B 65/025
See application file for complete search history.

(56) References Cited

U.S. PATENT DOCUMENTS 5,245,329 A 9/1993 Gokcebay
5,337,043 A 8/1994 Gokcebay
5,367,295 A 11/1994 Gokcebay et al.
5,552,777 A 9/1996 Gokcebay et al.
5,592,408 A 1/1997 Keskin et al.
5,886,644 A 3/1999 Keskin et al.
5,894,277 A 4/1999 Keskin et al.
6,000,609 A 12/1999 Gokcebay et al.
6,374,653 B1 4/2002 Gokcebay et al.
6,552,650 B1 4/2003 Gokcebay et al.
6,655,180 B2 12/2003 Gokcebay et al.
6,791,450 B2 9/2004 Gokcebay et al.
6,826,935 B2 12/2004 Gokcebay et al.
6,927,670 B1 8/2005 Gokcebay et al.
7,336,150 B2 2/2008 Gokcebay et al.
7,397,343 B1 7/2008 Gokcebay et al.
8,161,781 B2 4/2012 Gokcebay
8,490,443 B2 7/2013 Gokcebay
8,495,898 B2 7/2013 Gokcebay
9,208,628 B2 12/2015 Gokcebay
9,222,284 B2 12/2015 Gokcebay
9,273,492 B2 3/2016 Gokcebay
2003/0231103 A1* 12/2003 Fisher ..... G07C 9/00103 340/5.73
2009/0085717 A1* 4/2009 Kirkjan ..... G07C 9/00309 340/5.2
2013/0019784 A1* 1/2013 Yang ..... E05B 47/026 109/59 R (Continued)

*Primary Examiner* — Nabil Syed
(74) *Attorney, Agent, or Firm* — Thomas M. Freiburger

(57) ABSTRACT

In a system of locks, typically lockers for temporary use, but also including long-term lockers and locks in office furniture, each electronic lock has an access terminal for entry of a user's code. The electronic locks each have a processor and a programmable memory to receive inputs for setting and resetting access codes for the lock. The system includes a smartphone or other hand-held computer device, with a program for control of lock access. When locks of the system are to be set as to permitted access, or operating parameters of locks are to be adjusted, or for downloading information from the lock, information is entered into the smartphone and downloaded to a portable electronic data key. The data key is then touched to contacts of each lock to be affected, whereby the locks are set or the locks provide audit data to the smartphones.

14 Claims, 22 Drawing Sheets

(56) References Cited

U.S. PATENT DOCUMENTS

| | | | | |
|---|---|---|---|---|
| 2014/0360232 | A1* | 12/2014 | Al-Kahwati ..... | G07C 9/00571<br>70/14 |
| 2015/0332533 | A1* | 11/2015 | Meganck ..... | G07C 9/00309<br>340/5.61 |

* cited by examiner

Once logged in, the Main Utility screen will appear.

If successful, the user will be prompted to enter Manager Key holder's name. Issue date is optional.

Once a manager key is added, you can edit or delete the Manager Key.

Delete - removes the Manager Key.

Edit - "transfers" physical ownership of the Manager Key.

To edit the name, click on Edit. Or to delete one, click on Delete.

Once the OK button is selected, the Data Key is prepared to get information from the lock.

| Operated by | Date | Time | Action |
|---|---|---|---|
| Code | 09/15/2015 | 10:45 AM | Unlocked |
| Code | 09/16/2015 | 10:30 AM | Locked |
| Code | 09/14/2015 | 12:30 PM | Unlocked |
| Code | 09/14/2015 | 11:30 PM | Locked |
| Code | 09/14/2015 | 08:30 AM | Unlocked |
| Code | 09/14/2015 | 08:00 AM | Locked |
| Joe Carpenter | 08/17/2015 | 09:05 PM | Unlocked |
| Code | 08/17/2015 | 09:00 PM | Operation Failed |
| Code | 08/17/2015 | 06:35 PM | Locked |

ELECTRONIC LOCKER LOCK SYSTEM

BACKGROUND OF THE INVENTION

This invention concerns lockers, particularly lockers contained in a bank or group of similar lockers, and especially such lockers provided for temporary storage of a user's articles. This invention also concerns lockable cabinets as well as furniture, especially office furniture. More specifically the invention concerns a system of electronic locks on the doors of such a system of lockers, cabinets and furniture and the means by which these electronic locks are set and reset as to access codes, particularly manager access codes, as well as operating parameters. Typically access codes of users will be input via keypad, but the system can be one in which an RFID credential or other electronic credential is used, and in that case the locks can be set or reset as to those credentials using the system of the invention.

The following patents have some relevance to the current invention: U.S. Pat. Nos. 5,592,408, 5,245,329, 5,337,043, 5,367,295, 5,552,777, 5,886,644, 5,894,277, 6,000,609, 6,374,653, 6,552,650, 6,791,450, 6,826,935, 6,927,670, 7,336,150, 7,397,343, 8,161,781, 8,495,898, 8,490,443 and 9,208,628. U.S. Pat. Nos. 5,894,277 and 5,886,644 described locker locks with inner and outer housings that are connected to inner and outer sides of a locker door, with the locks connected together, optionally through the holes of a standard three-hole locker door prep. Access to a lock in these patents was obtained through a keypad or an electronic "key" device which was used to a transfer a code to the terminal of the lock. U.S. Pat. No. 6,655,180 disclosed electronic locker locks of generally similar construction, with a keypad as a primary means of access by entering a code, but also including a key reader receptacle to receive a code electronically, without the keypad, as an alternate means for accessing the lock. This may be in the possession of a manager, for example. The patent mentions that an audit trail feature can be included in the event that a plurality of managers each hold an electronic key, so that a record can be kept in the lock (and downloaded as needed) to show a history of electronic key access events. The above U.S. Pat. Nos. 6,000,609, 6,374,653, 6,552,650 and 9,208,628 also mention audit features in electronic locks. See also U.S. Pat. Nos. 8,495,898, 8,490,443, 9,208,628 and 9,222,284. All patents referenced in this paragraph are incorporated by reference in their entireties, and especially in regard to disclosures of audit modes, locker lock structures, and cam lock configurations, structures and operation.

There is a need for an electronic lock system, particularly for temporary-use lockers, cabinets and furniture but also for long-term or permanently assigned lockers, cabinets and furniture wherein locks can be conveniently, efficiently and securely set and reset as to operating codes and manager access codes, as well as controlling operating parameters and optionally retrieving audit information, using a smartphone or other small hand-held computer device.

SUMMARY OF THE INVENTION

The invention described below provides these advantages. In a facility with a large number of lockers, cabinets or furniture which may be for temporary use, each locker door has an electronic lock with an access terminal on the lock for entry of a user's code for access to the lock, allowing opening of the door. The access terminal usually has a keypad but could have another code entry device, such as one requiring contact of a key device with the terminal, or a wireless non-contact key device utilizing, for example, RFID, infrared, Bluetooth or NFC. Within each electronic lock is a processor and a programmable memory for receiving inputs relating to access codes and operating parameters. In locks wherein a temporary user selects and sets a code for temporary use, as is typical, the system of the invention enables a master or manager access code to be efficiently set and reset as needed. Preferably the lock has other settable parameters, which can include setting brightness or flashing frequency of an LED status indicator, volume of an audible tone generator that indicates lock status or code inputs, an automatic unlocking feature a specified period of time after locking (or at a specific time of day), and other operating parameters of the lock. The lock also preferably stores a history in the memory, listing events of accessing the lock, with time, date and access code used. This history information, which can be retrieved, will typically include instances of manager code use, or all lock accessing events.

The locks are programmable by and downloadable to a hand-held computer device such as a smartphone, the smartphone having a program (or "app") that provides for communication with each of the locks of the system, through an owner's key or "data key" device. For communicating with an individual lock, the smartphone preferably is connected by a cable to the data key, which is connected to the lock via a port on the lock. This simple connection prevents crosstalk to adjacent locks when a particular lock is being addressed, such as might be the case with wireless communication, e.g. Bluetooth, BLE or NFC, and also saves cost compared to those wireless protocols. However, there may be wireless communication between the smartphone and the data key. Connection to a particular lock "wakes up" the lock, and a two-way communication ensues, the lock confirming its ID and the smartphone providing programming and/or settings via the data key and the lock's processor, for setting or resetting access codes that will open the lock, as well as other functions or settings as listed above. A manager or supervisor can also download to the smartphone an audit trail when desired, in the event there is some question as to security and possible unauthorized entries.

The smartphone's program also stores information related to all lockers, cabinets or furniture (or combination of all) and locks in the system, by number or other individual ID, manager keys permitted access, the access code or codes which has been set for each individual lock, and other information as described below.

In the event a user-selected access code has been lost or forgotten, the locker, cabinet or furniture can be opened using a manager key authorized to have access to that locker, cabinet or furniture (or a group of them). In a keypad lock the user typically selects a code (e.g. four-digit) for the temporary use.

The locker, cabinet or furniture system preferably has locks as in U.S. Pat. No. 6,655,180, or U.S. Pat. Nos. 8,495,898, 8,490,443, 9,208,628, 9,222,284 and 9,273,492, wherein a keypad is employed for user access (although a wireless or contact electronic access protocol could be provided), set by a user to a desired code at each use, and with manager override access available by an electronic key device, contact or wireless. In this case the main concern of the invention is the manager access keys. The locks can be reprogrammed to add or exclude particular manager keys that can operate the locks. Accessing history can be important, especially (as is typical) if several manager keys have been issued, each having a transmittable ID. A lock's accessing history can be downloaded to the smartphone via the data key.

Additionally, operating parameters of the locks (or a group of locks) can be managed or reset via the owner's smartphone and data key.

It is thus among the objects of the invention to improve the convenience, efficiency and security of a system of locker, cabinet or furniture locks with electronic locks, particularly in the case of a large number of lockers, cabinets or furniture for temporary use. These and other objects, advantages and features of the invention will be apparent from the following description of a preferred embodiment, considered along with the accompanying drawings.

DESCRIPTION OF PREFERRED EMBODIMENTS

Figure 1:
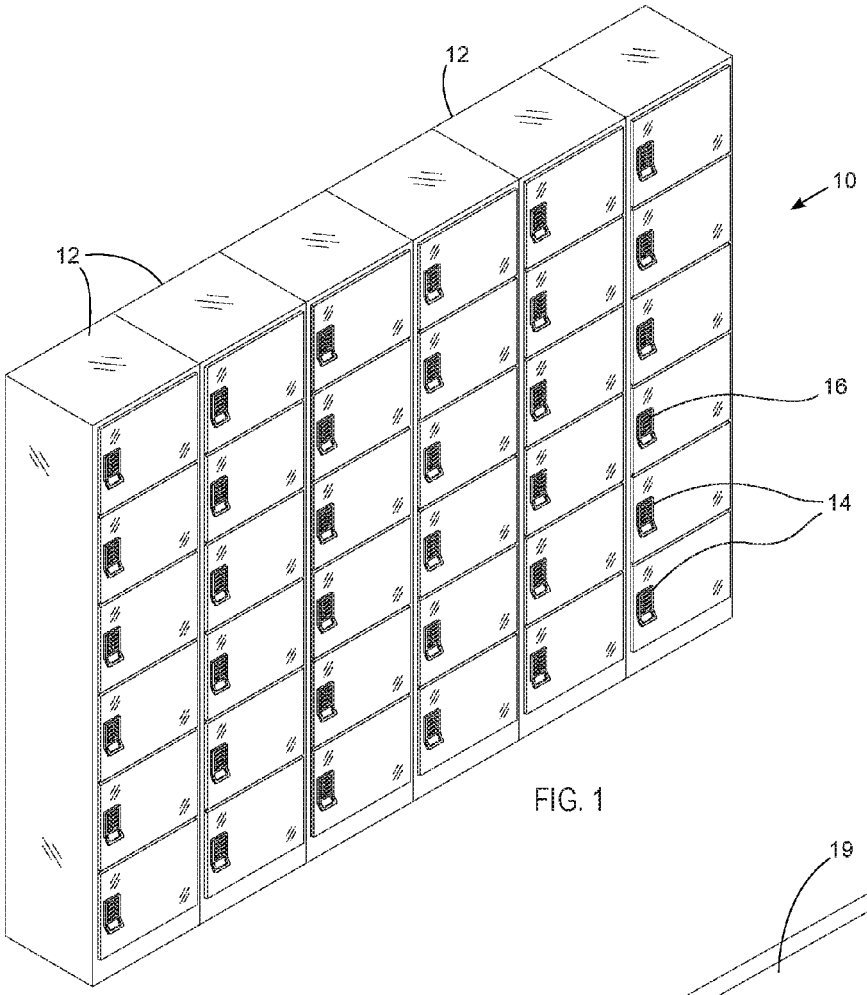
FIG. 1 is a perspective view indicating a group of lockers that can include the electronic lock system of the invention.
Figure 2:
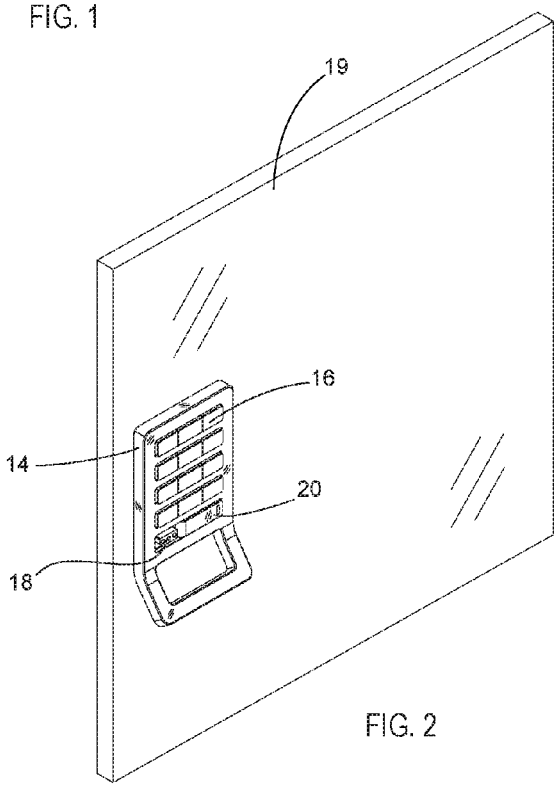
FIG. 2 shows a locker door with an electronic locker lock according to the invention.

In the drawings, FIG. 1 shows a bank 10 of lockers of the type of which the invention is concerned, in this case six side-by-side vertical locker units 12 each with multiple tiers of lockers, and with electronic locker locks 14 accessed by keypads 16 in normal use by a temporary user. FIG. 2 shows a locker door 18 with the electronic locker lock 14 and its terminal comprising a keypad 16. The lock 14 also includes a separate access terminal 18 for manager access, and it can include additional operation keys 20 (such as may be needed to activate the lock prior to entering the code).

Figure 1A:
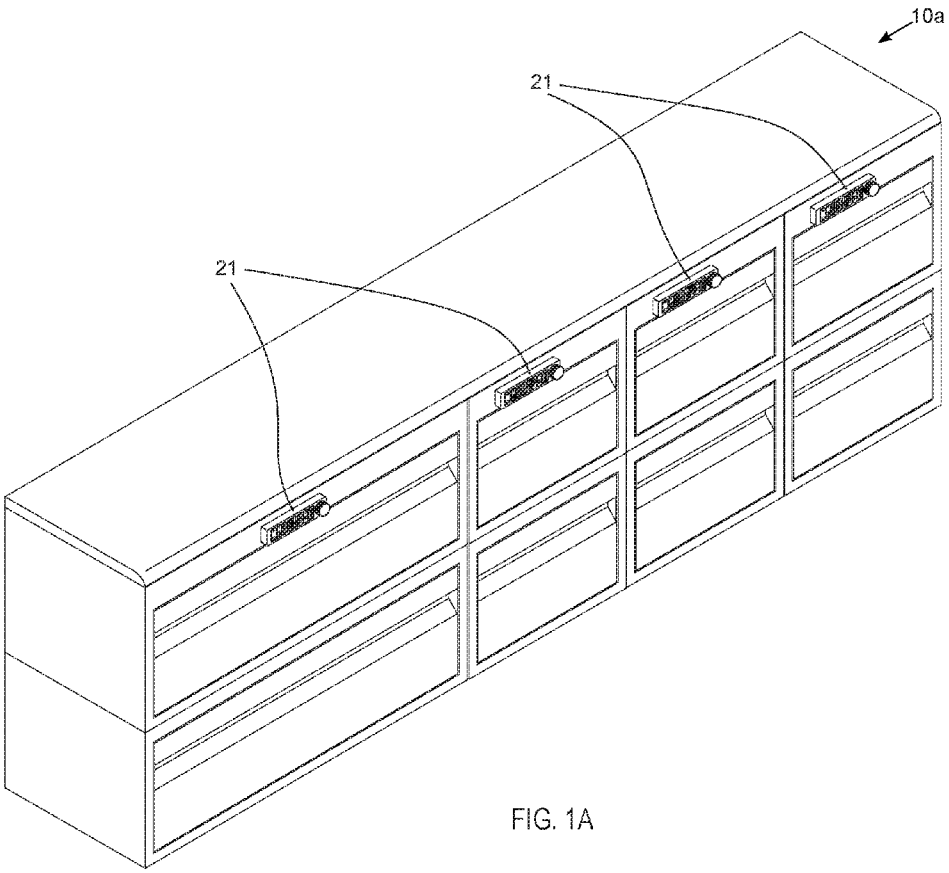
FIG. 1A is a perspective view showing cabinets or furniture with cam locks that can include the electronic lock system of the invention.

FIG. 1A shows a row of file cabinets 10*a*, typically among a larger number of file cabinets and/or other lockable office furniture. Typically there will be a multiplicity of such lockable office furniture items, each with an electronic cam lock such as shown at 21. These can be, for example, similar to those locks shown and described in U.S. Pat. No. 9,273,492, referenced above, the content of which, particularly regarding cam locks, is incorporated herein by reference. In this case the cam locks 21 have electronic access features, processor and memory as described herein in regard to locker locks, and they can be set and reset as to manager codes, parameters and other features in accordance with the system of the invention. The discussion below should be understood as applying to such a system of lockable office furniture as well as lockers, unless the discussion is limited to lockers. Usually office furniture will have assigned user codes, but some such furniture, as in a distributed desk system for temporary users, can have temporary use file cabinets, desks, etc.

Figure 3:
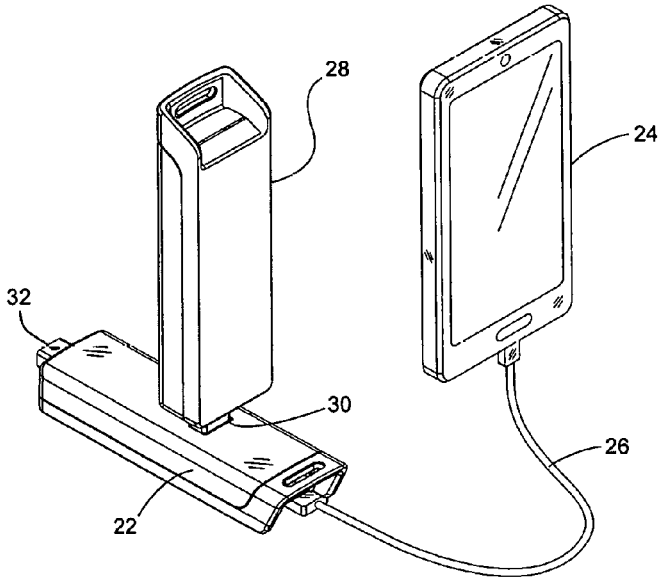
FIG. 3 is a perspective view indicating a smartphone connected by a cable to electronic lock accessing and programming equipment of the invention, including a manager key and a data key.

FIG. 3 shows key management equipment of the invention. This equipment includes an owner key or data key 22 and a mobile device or smartphone 24, shown connected by a cable 26 to the data key 22. A manager key 28, which can be one of several, is shown in contact with the data key 22, at a data key port 30. This is a momentary contact (contact long enough to exchange data—tone or LED confirms). Instead of the cable 26 a wireless connection can be made between the smartphone 24 and the data key 22, e.g. Bluetooth, NFC or infrared communication.

As described below, the smartphone 24 has an app that communicates with the data key 22 to enable adding, editing and deleting names of managers who are to hold the manager keys, and to set features in the locks. After the changes are made using the smartphone 24, the changes or settings are loaded into the data key 22. In the case of manager key assignment, a manager key 28 is touched to the contacts of the data port 30 on the data key after a manager's name has been added and loaded into the data key. This is done by a supervisor or supervising manager. Each manager key 28 has its own ID number or code to identify itself, and this is registered in the system along with the manager's name.

Figure 4:
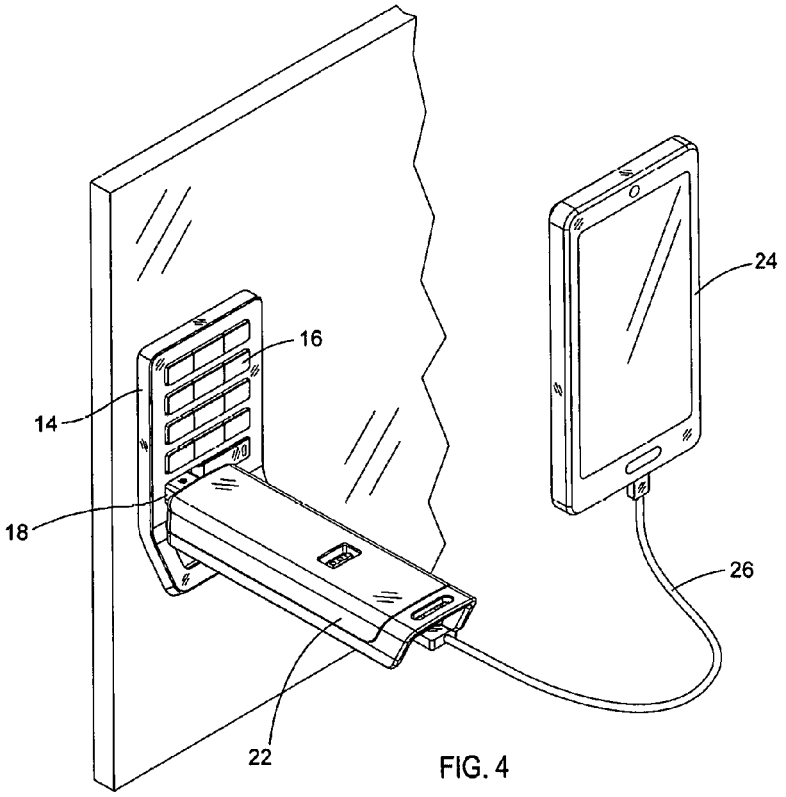
FIG. 4 is a perspective view showing a data key in contact with an electronic lock and connected to the smartphone.

Preferably clock functions when needed in the program are provided by the smartphone 24. When locks are to be programmed, a data contact end 32 of the data key is touched to the data terminal of each lock to be affected, as shown in FIG. 4. At this point the manager keys to be operational have already been selected and programmed into the data key 22, and the new settings and data are entered into the locks as indicated in FIG. 4.

Figure 8:
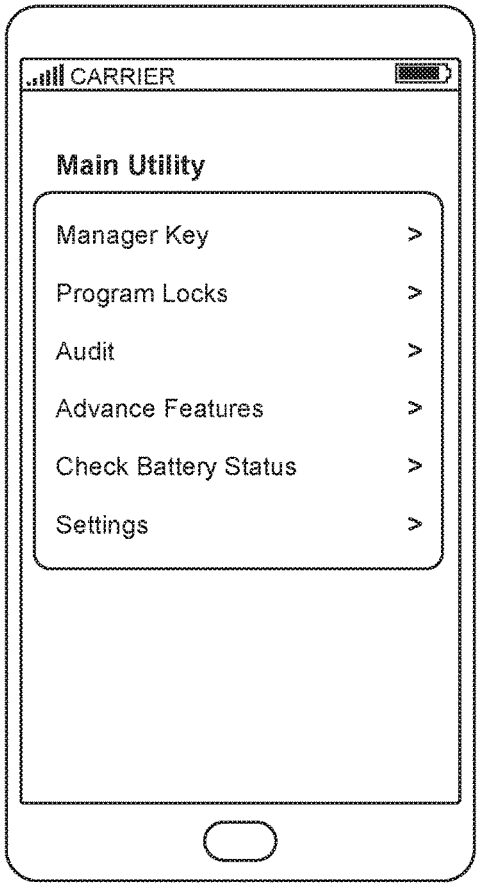
FIGS. 8 through 24 show screenshots of a smartphone used for key management in the system of the invention.

The screenshots schematically indicated in FIG. 8 et seq. indicate one preferred procedure for use of the manager key of the locker lock/manager key system of the invention, as used by a supervisor on a smartphone or other portable electronic device, preferably a small touchscreen device. During use of the smartphone for the routines to be described, the smartphone preferably is connected to the data key 22. However, the system can be set up so that once the data from the smartphone has been loaded to the data key, the programming of the locks at each locker can be done using the data key alone.

Manager Keys

Figure 9:
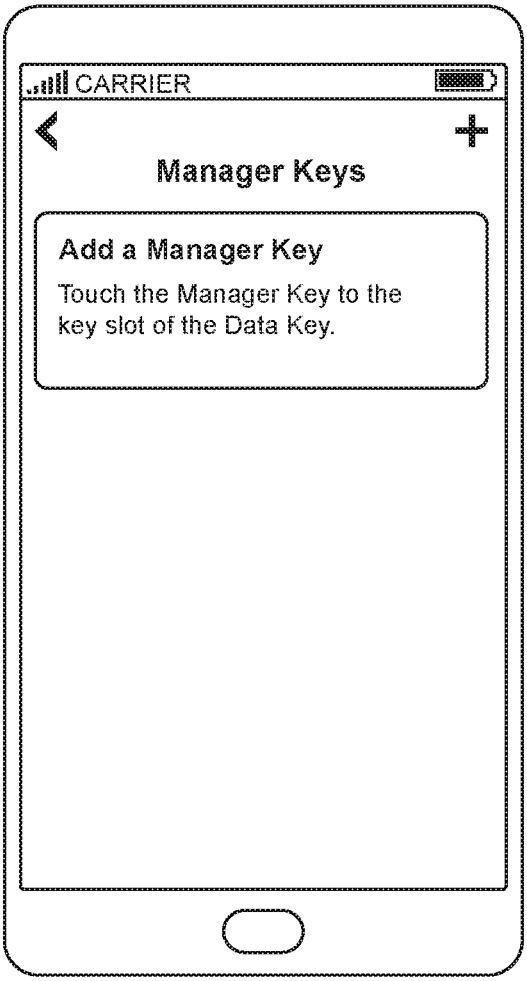
Figure 10:
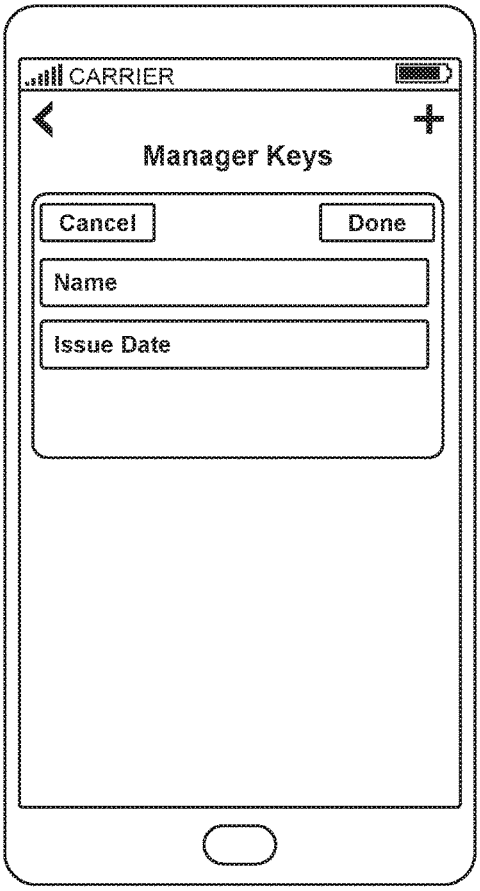
Figure 11:
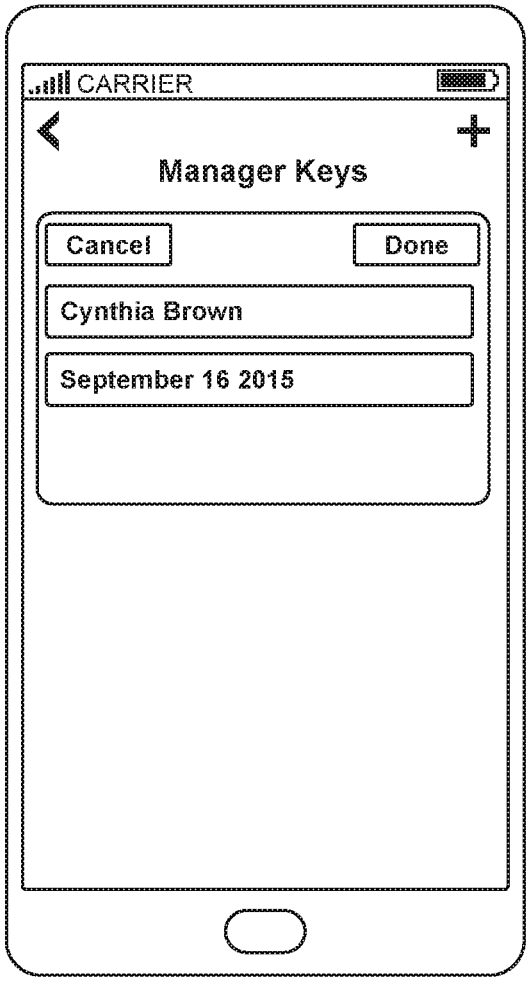

FIG. 8 shows a main utility screen that will appear once a user/supervisor of the system has successfully logged in. The screen gives the user/supervisor a menu with a series of functions for selection. First it is assumed the supervisor selects (by touching) the manager keys. The screenshot of FIG. 9 confirms this. To add a manager key into the system, the user/supervisor touches the plus sign at the upper right, and the user/supervisor is prompted to touch the manager key to the data key's slot or port. The data key waits for a manager key to be touched to the port of the data key, which enables the data key to read the manager key's ID. With that ID known in the data key, FIG. 10 shows that the user/supervisor is prompted to enter the name of the manager key holder. Entry of an issue date can be automatic. "Done" is touched when manager information has been entered. FIG. 11 shows a manager's name has been entered, with the current date. If needed the user/supervisor can then add additional manager keys, with key holder names.

Figure 12:
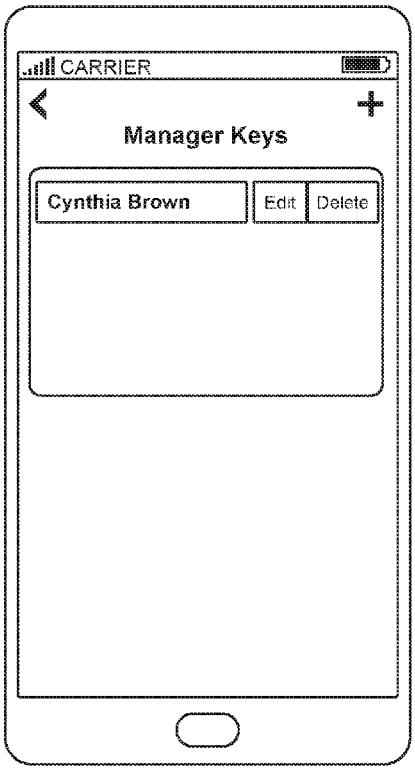

FIG. 12 indicates the screen gives the option to edit or delete a manager. Touching "edit" enables transfer of a manager key from one manager to another, without having the manager key in hand.

Figure 13:
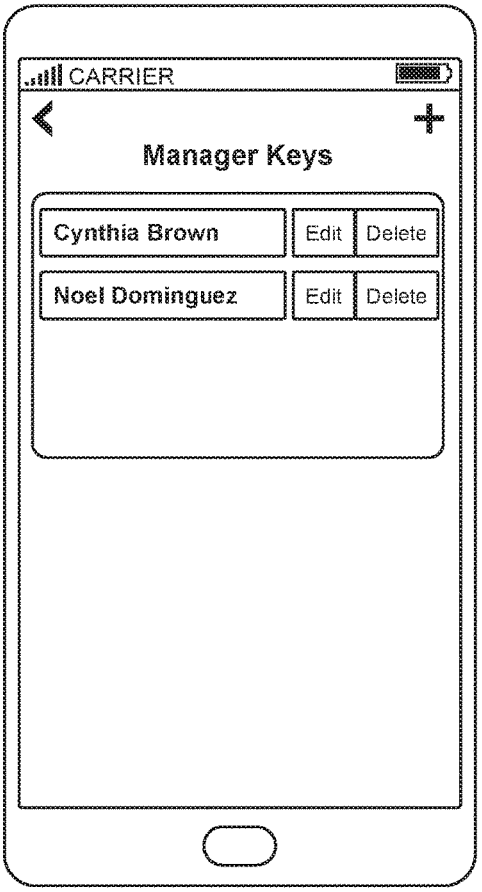

FIG. 13 shows a screen with two managers in the smartphone's registry, each being associated with a manager key.

Figure 14:
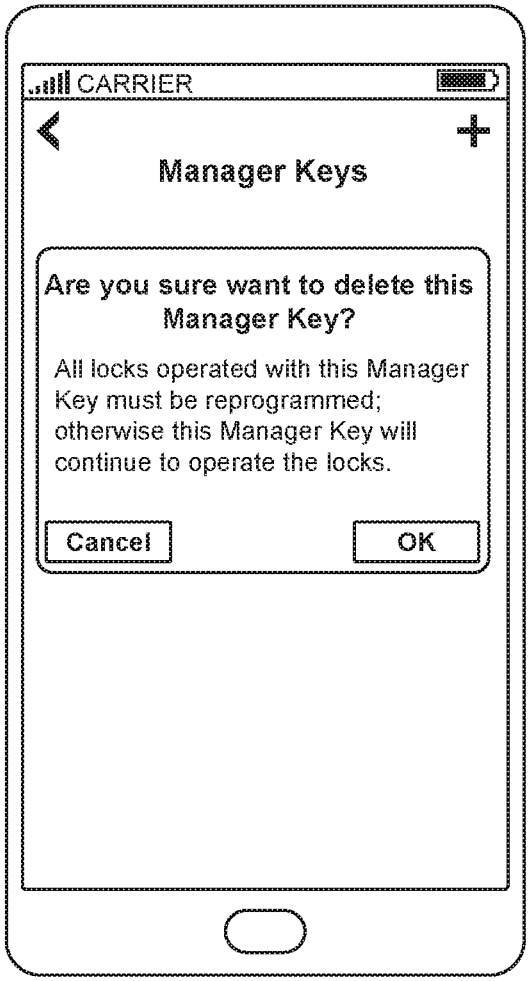

If a manager is deleted by touching the "delete" button, a screen such as shown in FIG. 14 preferably appears, requesting confirmation of managers to be deleted and warning that all locks operable with this manager key must be reprogrammed, so that the deleted manager key can no longer be used to access the locks. Each lock maintains in its database a list of which manager keys will be accepted.

If a user/supervisor has selected "manager keys" on the main utility screen (FIG. 8), then touches to the data key a manager key already assigned to someone, the system will show the existing key holder's name. If the user/supervisor wants to proceed to edit the assigned key holder the system will allow editing to change the name of the assigned person.

Program Locks

Figure 15:
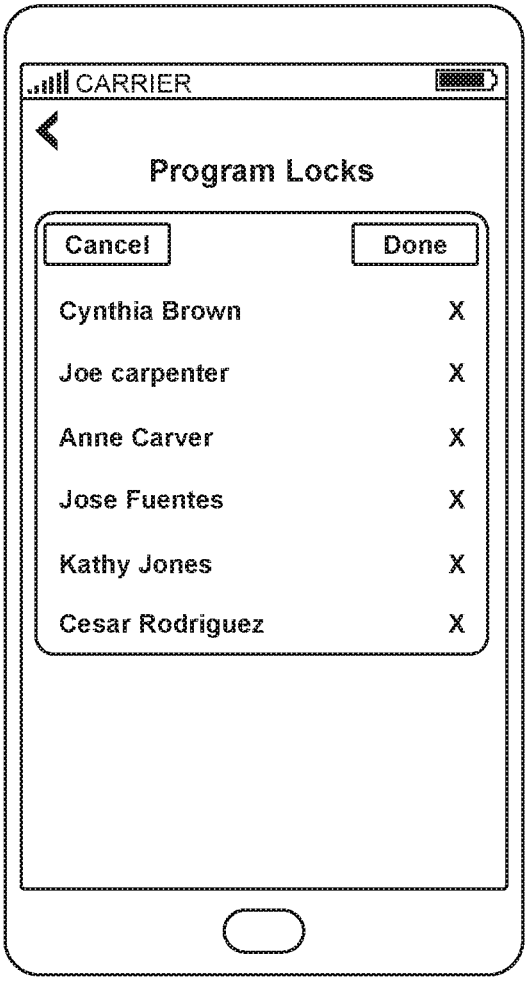
Figure 16:
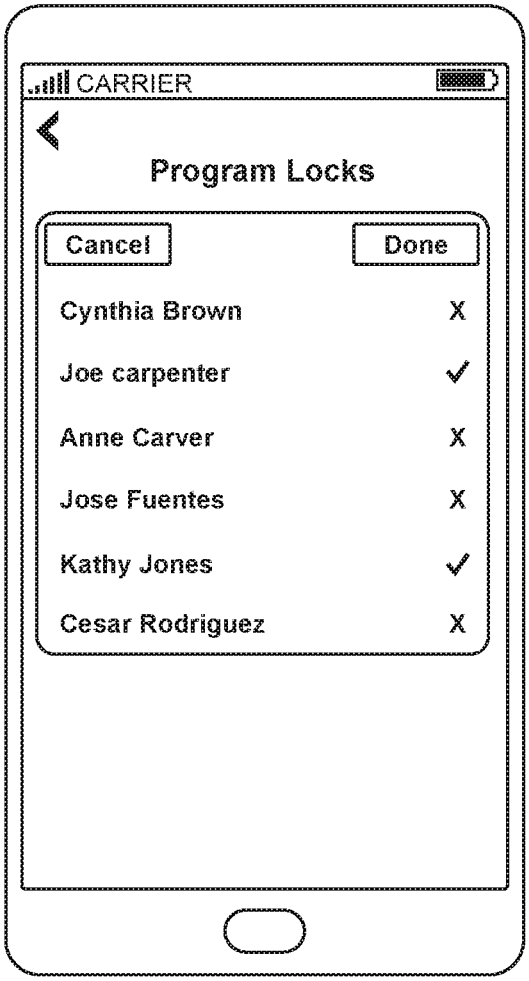
Figure 17:
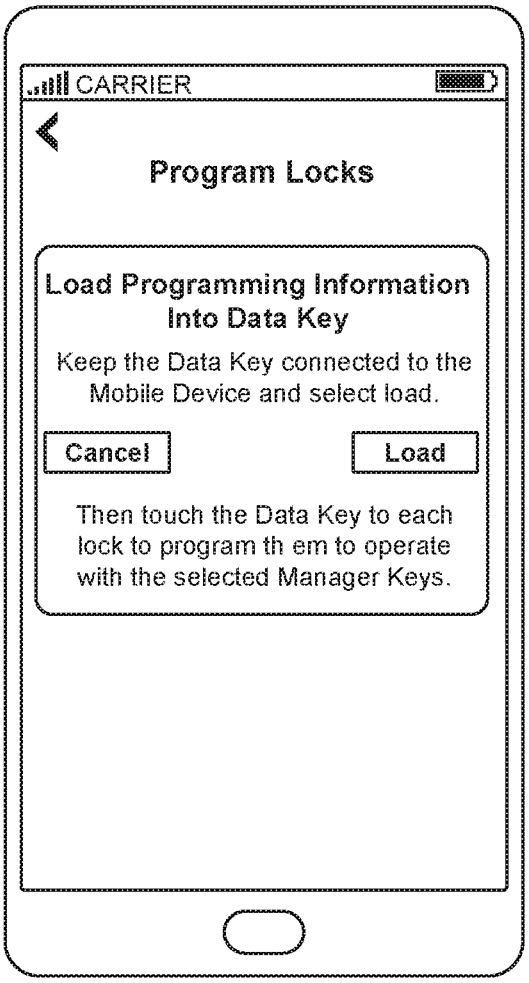

With manager key assignments or re-assignments completed, the user/supervisor will want to program the locks affected by the subject manager keys. From the main utility screen shown in FIG. 8, the user/supervisor selects "Program Locks". FIG. 15 shows a screen that will appear, showing all managers associated with manager keys. To the right of each person's name is shown an "X" (no access), which can be changed based on which managers are selected for access to the group of locks that are to be programmed at this time. FIG. 16 shows that three managers on the manager registry, Brown, Carver and Jones (shown checked), are to be permitted access to the group of locks that are to be programmed. Then, FIG. 17 shows that the user/supervisor is prompted to load the program information into the data key 22 (by touching "Load" on the screen while the smartphone 24 remains connected to the data key 22). Also, the screen of FIG. 17 instructs the user/supervisor to touch the data key to each lock that is to be programmed to operate with the selected manager keys. Preferably the smartphone remains connected to the data key while the user/supervisor touches the data key to each lock. In this way, if desired, confirmation can be stored in the smartphone as to which locks have been programmed to receive the manager key of the selected managers. Note that if such a confirmation record is not needed, the data key 22 could store all the needed data as to selected managers, and the data key could be touched to each affected lock without connection to the smartphone, which is easier for the person setting the locks.

If, for example, the remaining three managers shown in FIG. 16 are to have access to a different group of locks, "Program Locks" is again selected and only the remaining group of managers is checked for having access. The same routine described is repeated for another group of lockers/locks. FIG. 17 shows the screen for prompting the user/supervisor to use the data key, connected to the smartphone or the mobile device, select "Load" and then touch the data key to each lock to be programmed or re-programmed. All such locks will then be accessible by and only by the selected manager keys, which are not physically part of the lock programming procedure carried out by the user/supervisor. The locks or the data key or smartphone can emit a "beep" tone or flash an LED to confirm the data has been loaded into the lock. The system of the invention thus eliminates the need to gather all manager keys (which can be five or even ten) and to physically involve them in reprogramming to add or exclude manager keys from a group of locks.

Audit

Figure 18:
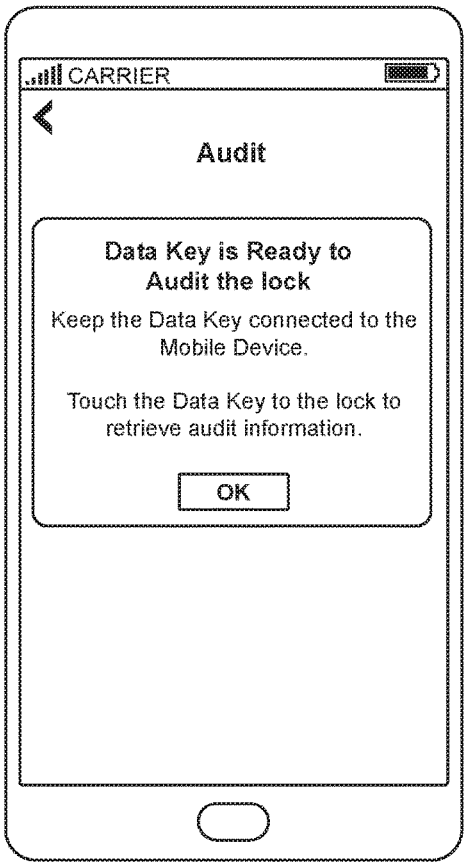
Figure 19:
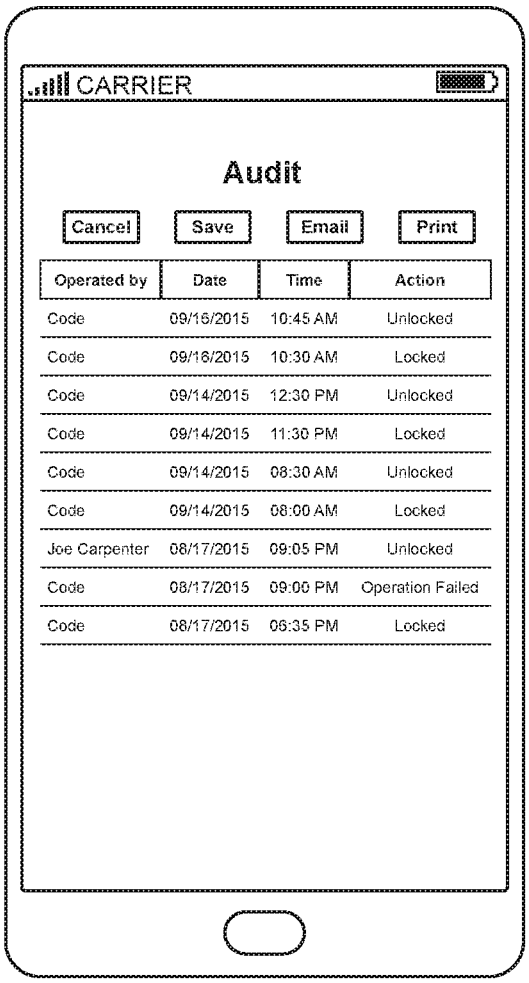

The "Audit" feature may be selected when needed. See FIG. 8, showing the main utility screen. The audit arrow is touched by the user/supervisor. FIG. 18 shows a screen that preferably will appear after such selection. In FIG. 18 the screen indicates the data key is ready to audit a lock and that the data key must remain connected to the mobile device. Once the "OK" button is touched, the data key can then be touched to the lock's terminal to obtain the desired information, which is shown, for example, in FIG. 19. On that screen a series of nine lockings and unlockings are listed in the order of occurrence, latest on top. The word "Code" indicates a customer's locking and unlocking of this locker using a customer-selected code, in the usual procedure. The bottom three events listed show a customer's locking the lock, but later failing to successfully open the lock. A manager, Joe Carpenter, then opened the lock using his manager key. If desired the listing of events can include many more events, over several months or many months of use.

If the locker, cabinet or furniture was an assigned locker rather than a locker for temporary use, the audit trail will show that the lock was operated by the user/supervisor's assigned code, and, if applicable, any events of manager access, including the name of the manager. The audit trail can also show any unsuccessful attempted entries.

Advanced Features

Figure 20:
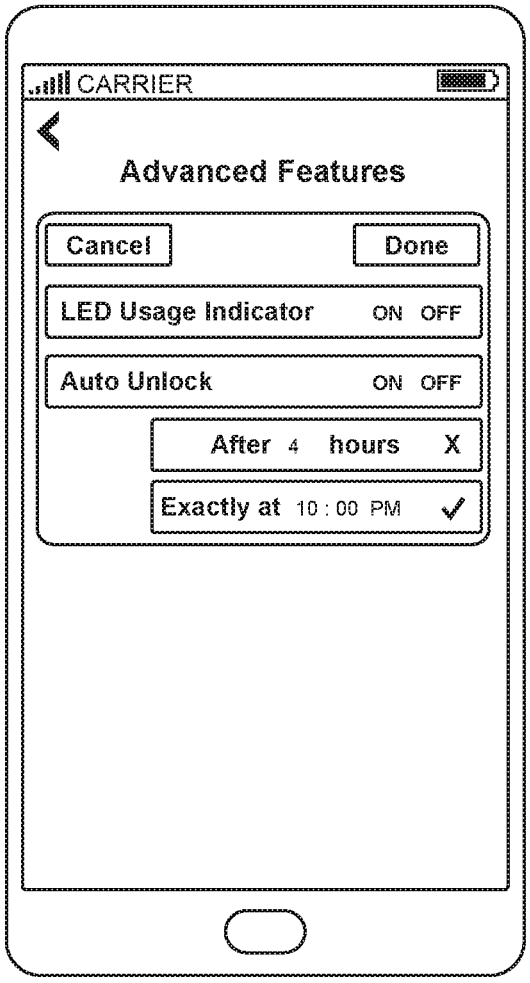
Figure 21:
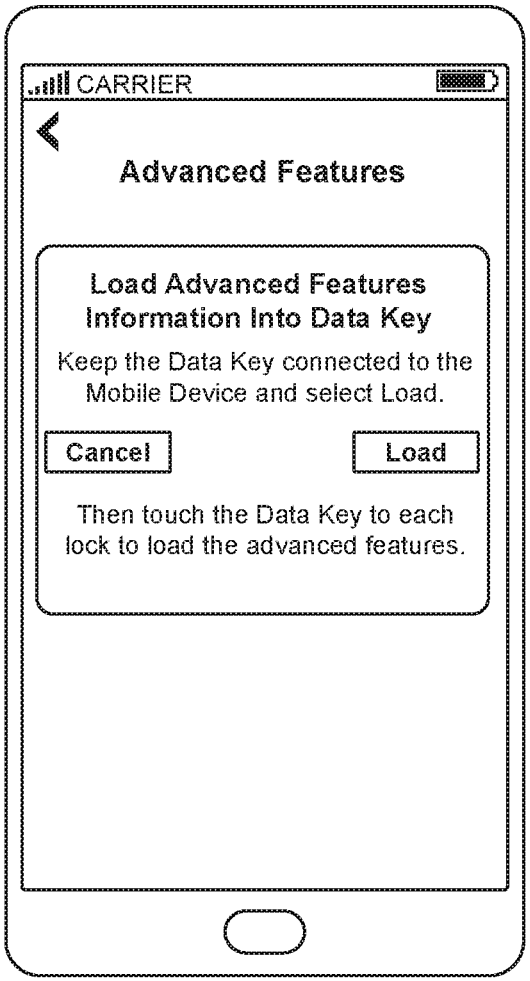
Figure 22:
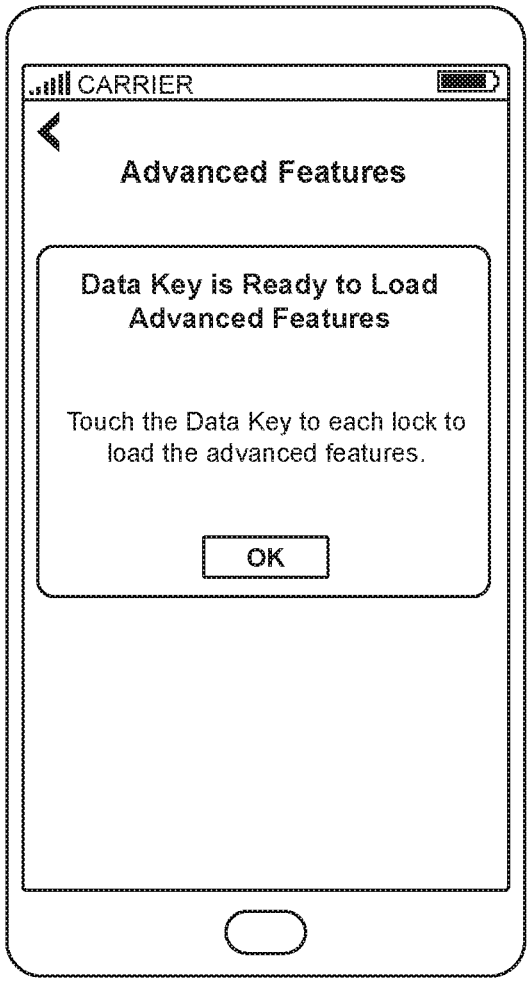

Advanced features relate to such settings as automatic unlocking after a prescribed number of hours or at a prescribed time, LED usage, LED brightness, audio features, etc. The screen in FIG. 20 shows a current status in which the LED usage indicator is "ON", and the audio unlock feature is also "ON". The latter feature is set to a prescribed hour of the day at which the lock will automatically be unlocked. As noted, a duration of usage time could also be selected. As noted above, several other advanced features can be included in the lock. Once these features have been set as desired, the user/supervisor touches the "Done" button and the screen shown in FIG. 21 appears. Again, the user/supervisor is prompted to maintain the connection of the data key and the smartphone or mobile device, and to select "Load", then touch the data key to each lock desired to have the selected advanced features. The screen can then display a prompt such as shown in FIG. 22. As noted above, the system can be such that only the data key need be taken to each lock.

Check Battery Status

Figure 23:
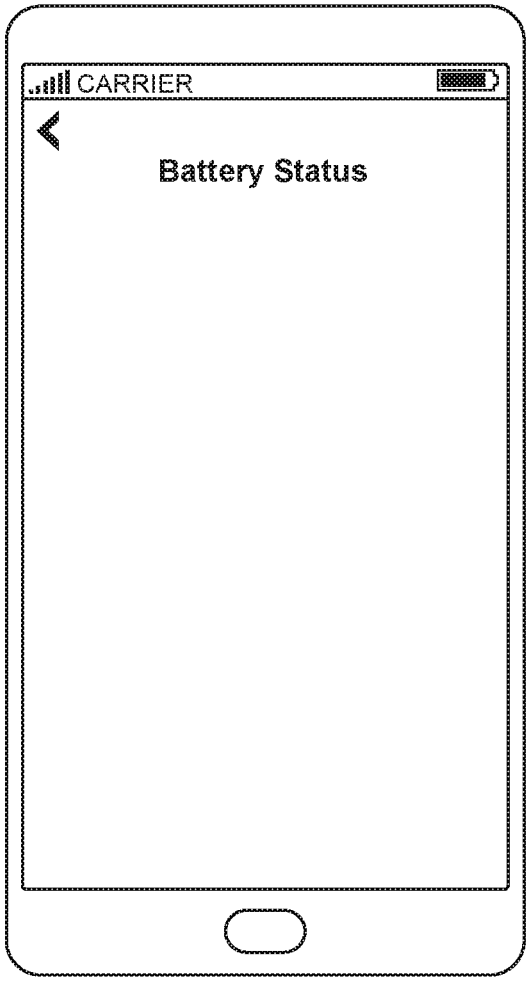
Figure 24:
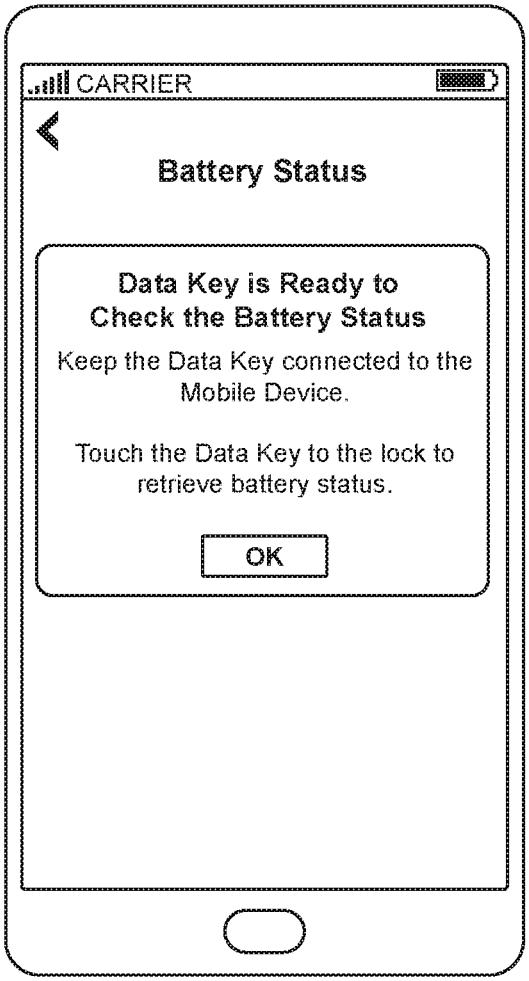

If the user/supervisor needs to check the battery status of one or more locks, the "Check Battery Status" selection is made on the main utility screen such as shown in FIG. 8. The screen then displays "Battery Status", as shown in FIG. 23. The user/supervisor indicates on that screen to proceed, and the screen of FIG. 24 appears, with instruction to maintain the connection to the mobile device, and to touch the data key to the lock of interest, to retrieve battery status. Once the "OK" button is touched, battery status is displayed, which may be in a graphic or stated as a percent.

In addition to the above features, the app of the smartphone preferably also enables an owner or supervisor to set an operating window of a lock for use by a user (temporary or not) or manager, including a one-time use by a visitor. The setting is made on the smartphone (screen not shown), prompting the supervisor to enter the manager or key code, or visitor, and an operating window of time (including date(s)) to include or exclude one or more such managers or specific user keys or to prevent temporary use by any user-selected digit combinations. After download of the data to the data key, the data key is touched to the locker(s) to be affected.

Figure 5:
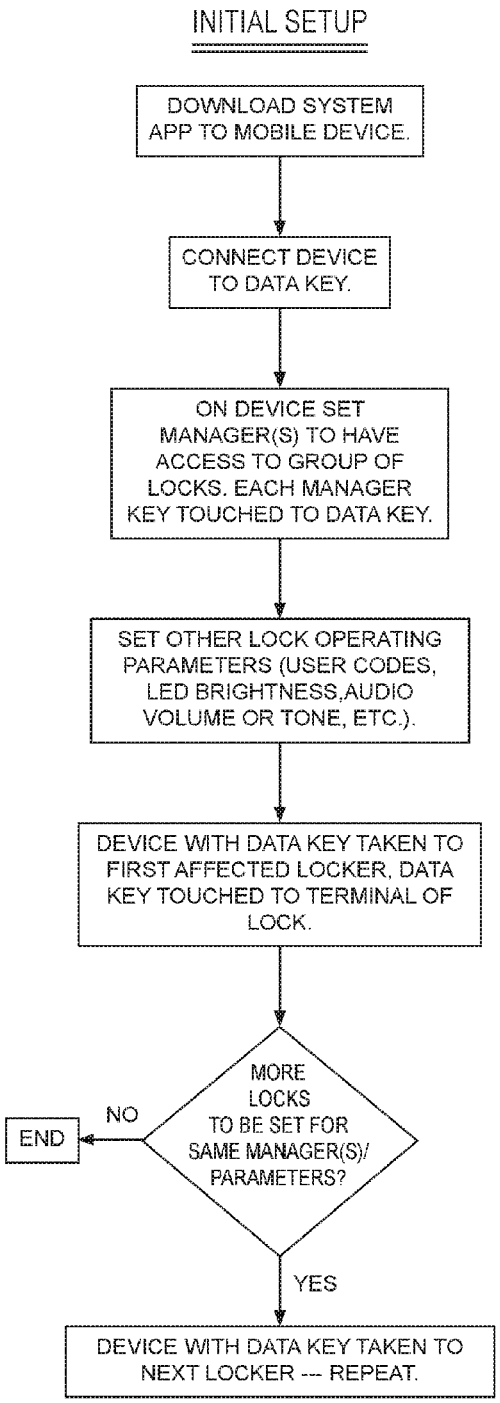
FIG. 5 is a flow chart indicating a procedure for initial setup of locks to set the locks to a particular manager key code.
Figure 6:
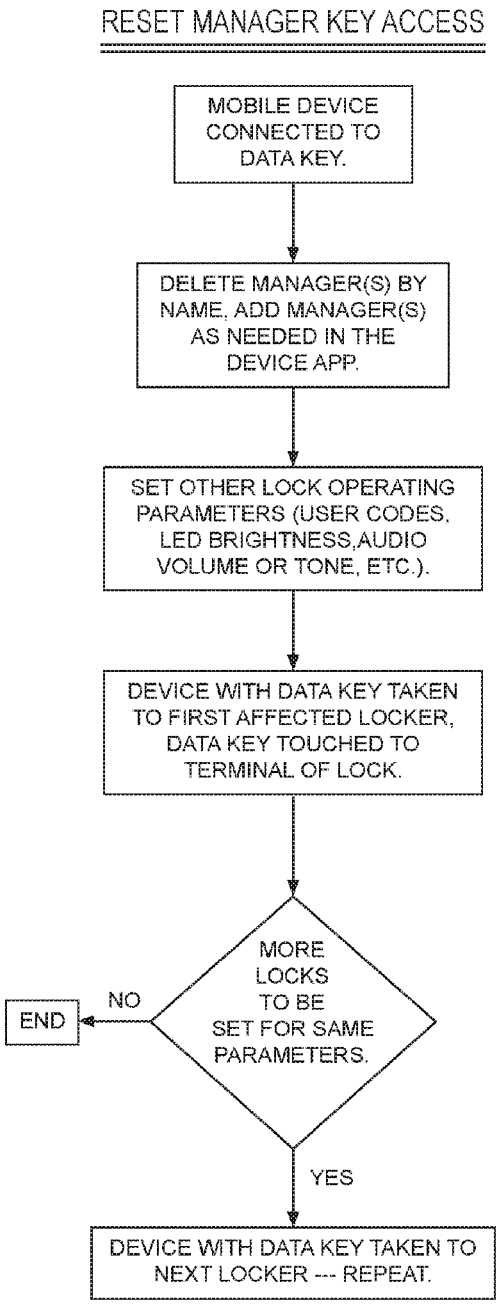
FIGS. 6 and 7 are further flow charts showing the system of the invention, for resetting a manager access code and for lock operation.
Figure 7:
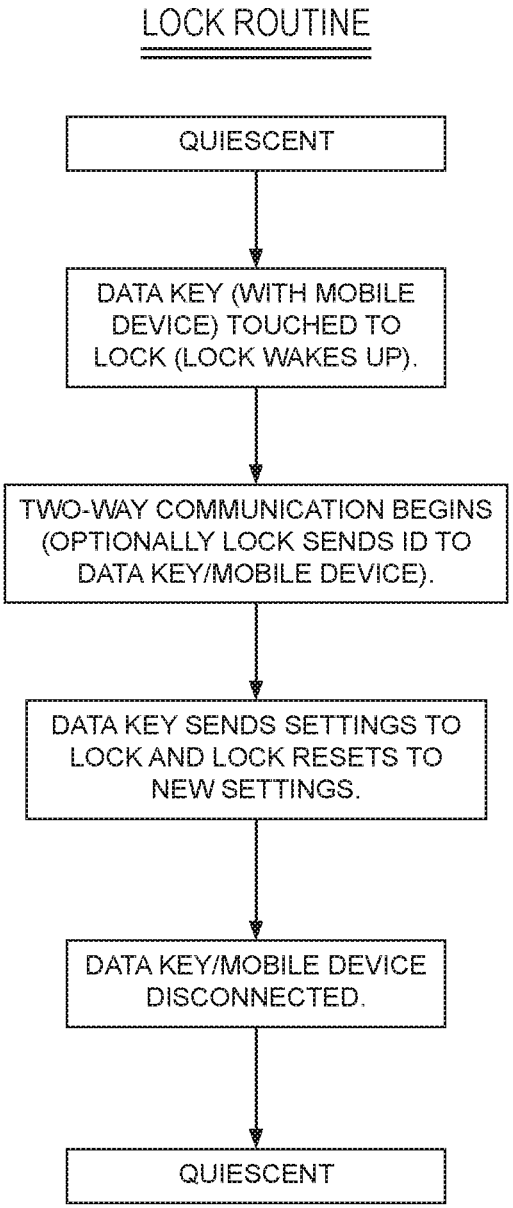

FIGS. 5, 6 and 7 are flow charts showing routines in the system of the invention. The flow charts are self-explanatory.

FIG. 5 shows initial setup, wherein each manager key is newly issued and must be touched to the data key, as discussed above and shown in FIG. 3. FIG. 6 indicates resetting of manager key access, which can also involve resetting of operating parameters for the locks if desired. FIG. 7 is from the point of view of a lock.

References to a smartphone herein and in the claims are intended to include other hand-held mobile computer devices, particularly those with touch screens.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. In a system of many lockers, each of which has an electronic lock on an openable door that provides ingress but no egress, with an access terminal on the lock for entry of a user's code to allow the user to access and open the lock, the improvement comprising:

the system including, in addition to access by users via user's codes, manager access via a plurality of electronic manager keys, each to be held by one of a plurality of managers to provide overriding access to lockers when a user cannot access a lock, each lock of the system having a processor and a programmable memory capable of receiving inputs for setting and resetting access codes for the lock, a keypad or other code entry device on said access terminal and connected to the processor for access by users using the lockers, and a data port with communication contacts, a data key comprising a portable electronic device with a processor and a programmable memory, the data key including data contacts to connect with one of said locks when desired by touching the data contacts to the lock's communication contacts, and further including a data port to receive and make electronic contact with one of said manager keys, a smartphone or other hand-held computer device, the smartphone having a program for entering a manager name or ID on the smartphone to be associated with each electronic manager key, and for communicating via the data key with each of the locks of the system to set and reset user or manager access codes that will operate locks of the system, communication means connecting the smartphone or device and the data key, each said electronic manager key having accessing contacts configured to mate with the communication contacts of the lock for manager access to the lock, and said accessing contacts also configured to mate with the data port of the data key to enable communication between the manager key and the data key including identity of a manager key touched to the data key, and the data key when touched to the data port of a lock of the system being capable of sending data to the processor and programmable memory of the lock to set and change permitted user or manager access codes that can access the lock.

2. The system of claim 1, wherein the smartphone and data key when connected to a lock of the system are capable of retrieving data from the programmable memory of the lock to reveal a history of events of access to the lock.

3. The system of claim 1, wherein each lock includes an LED indicator to show status of the lock, and wherein the smartphone when connected via the data key to a lock of the system is further capable of setting brightness of the LED indicators.

4. The system of claim 1, wherein each lock includes an audible tone generator to indicate lock status or code input, and wherein the smartphone when connected via the data key to a lock of the system is further capable of adjusting audible tone volume or type of tone.

5. The system of claim 1, wherein the smartphone when connected via the data key to a lock of the system is further capable of setting operating parameters of the lock.

6. The system of claim 1, wherein the communication means comprises a cable connected to the smartphone or device and to the data key.

7. The system of claim 1, wherein the communication means comprises wireless communication.

8. The system of claim 1, wherein the smartphone program enables entry into a registry of the smartphone of a manager name to be associated with a manager key after the manager key has been touched to the data contacts of the data key.

9. The system of claim 1, wherein each lock has an audible tone generator to emit a tone confirming a successful transfer of data from the data key to the lock.

10. A method for controlling access to a multiplicity of electronic locks on lockers, cabinets or office furniture, in a system that includes access to the lockers by locker users via individual locker user's codes as a locker user level of access, and manager access via a plurality of electronic manager keys, each to be held by one of a plurality of managers to provide overriding access to locks when a user cannot access a lock, as a manager level of access, comprising the following steps, performed by a supervisor:

(a) connecting a smartphone to a portable electronic data key device, the smartphone having an app for setting and controlling access to the electronic locks, (b) selecting an electronic manager key device and touching contacts of the manager key device to contacts of the data key device, to thereby provide identification of the manager key device, (c) with the app running, monitoring the screen of the smartphone, and entering a name or identification of a manager or person to be assigned the manager key, (d) repeating steps (b) and (c) for any additional manager keys and managers who are to be permitted access to a group of locks, (e) using the app on the smartphone, loading the information regarding manager keys and managers into the data key, and (f) taking the data key to each lock to be affected with information loaded into the data key, and touching contacts of the data key to contacts of each lock, whereby a programmable memory of each lock contacted by the data key receives inputs to control which manager keys are permitted access to the lock.

11. The method of claim 10, further including using the smartphone app to delete and add managers to have access to selected locks, downloading data regarding one or more deleted or added managers from the smartphone to the data key, and touching the data key to said selected locks, so that the selected locks will only allow access to authorized managers.

12. The method of claim 10, further including entering on the smartphone settings of parameters for locks, including operation settings of LEDs or audible tones, or time windows within which a lock is to be accessible by a particular manager.

13. The method of claim 10, further including entering on the smartphone using the app a time window within which a particular manager or key code or group of codes are to have access or no access to selected locks, including entering such manager key code or codes into the smartphone using the app, downloading data from the smartphone to the data key, and then touching the data key to said selected locks so that the selected locks will only allow access as input into the app on the smartphone.

14. A method for controlling access to a multiplicity of electronic locks, each having an access terminal, a processor and a programmable memory or data storage, comprising the following steps, performed by a supervisor:

(a) connecting a smartphone to a portable electronic data key device, the smartphone having an app for setting and controlling access to the electronic locks, (b) selecting an electronic manager key device and touching contacts of the manager key device to contacts of the data key device, to thereby provide identification of the manager key device, (c) with the app running, monitoring the screen of the smartphone, and entering a name or identification of a manager or person to be assigned the manager key, (d) repeating steps (b) and (c) for any additional manager keys and managers who are to be permitted access to a group of locks, (e) using the app on the smartphone, loading the information regarding manager keys and managers into the data key, (f) taking the data key to each lock to be affected with information loaded into the data key, and touching contacts of the data key to contacts of each lock, whereby the programmable memory of each lock contacted by the data key receives inputs to control which manager keys are permitted access to the lock, and further including using the smartphone app to delete and add managers to have access to selected locks, downloading data regarding one or more deleted or added managers from the smartphone to the data key, and touching the data key to said selected locks, so that the selected locks will only allow access to authorized managers.

* * * * *